US005383732A

United States Patent [19]

Berson et al.

[11] Patent Number: 5,383,732

[45] Date of Patent: Jan. 24, 1995

[54] THERMAL PRINTING POSTAGE DISPENSING DEVICE HAVING SECURITY FEATURES AND METHOD OF USING

[75] Inventors: William Berson, Westport; David W. Hubbard, Stamford, both of Conn.

[73] Assignee: Pitney Bowes Inc., Stamford, Conn.

[21] Appl. No.: 169,104

[22] Filed: Dec. 20, 1993

[51] Int. Cl.[6] ..... B41J 2/315

[52] U.S. Cl. ..... 400/120.01; 400/232; 400/240; 101/91

[58] Field of Search ..... 400/120, 232, 240, 120.01; 346/1.1; 101/91

[56] References Cited

U.S. PATENT DOCUMENTS

| | | | |
|---|---|---|---|
| 4,746,234 | 5/1988 | Harry | 101/91 |
| 4,773,953 | 9/1988 | Hare | 400/65 |
| 4,854,754 | 8/1989 | Miura et al. | 400/120 |
| 4,895,465 | 1/1990 | Mecke et al. . | |
| 4,938,129 | 7/1990 | Miciukiewicz et al. | 400/661.3 |
| 5,099,256 | 3/1992 | Anderson | 346/1.1 |
| 5,122,882 | 6/1992 | Ishida et al. | 400/232 |
| 5,248,994 | 9/1993 | Yoshida et al. | 400/232 |

FOREIGN PATENT DOCUMENTS 0189269 2/1992 European Pat. Off. .

*Primary Examiner*—Edgar S. Burr
*Assistant Examiner*—John S. Hilten
*Attorney, Agent, or Firm*—Ronald Reichman; Melvin J. Scolnick

[57] ABSTRACT

A thermal printing postage dispensing apparatus that is able to print a postage indicia on a mail piece in a secure manner. A thermal ribbon is provided which has pre-formed images thereon that are of a reduced size in the longitudinal direction. When the images are to be transferred to an envelope to print a postage indicia by a dot matrix thermal printer, the envelope is driven at a greater speed than the ribbon. This results in the indicia being printed on the envelope with a standard size. The preformed images represent the non-variable portion of a postage indicia; whereas, the variable data of the postage indicia is printed by a thermal printer in blank areas left by the pre-formed images.

12 Claims, 1 Drawing Sheet

THERMAL PRINTING POSTAGE DISPENSING DEVICE HAVING SECURITY FEATURES AND METHOD OF USING

BACKGROUND OF THE INVENTION

With the rapid advancements in the field of printing, newly developed printing techniques are being considered in the field of postage dispensing. Heretofore, postage dispensing devices, for the most part, have used mechanical devices for the purpose of printing postage indicia upon mail pieces. In the recent past, electronic postage dispensing devices have been developed, but even these electronic devices relied upon mechanical printers that were in communication with electronic accounting components. Needless to say, such postage dispensing devices provide security for the accounting of postage, but are relatively expensive although dot matrix printers have been developed and are commercially available, such as ink jet printers and thermal printers, none is used presently as a stand alone postage dispensing device because of the lack of security.

Many publications have discussed and suggested the use of dot matrix printers in postage dispensing devices. In fact, recent changes in the postal regulations allow mailers to use ink jet printers for printing certain data on letters. As a result, it appears to be a matter of time before postal regulations are changed to allow more extensive use of dot matrix printers. Of the contemporary printing techniques available, the use of thermal printing for a postage dispensing device appears attractive and has been disclosed in a number of articles and patents. The advantages offered by thermal printing are that of low cost and reliability. One drawback to the use of a thermal printer is that a scheme for providing security must be provided; otherwise, a wrong doer could print postage indicia on mail pieces with an unauthorized printer. By unauthorized printer is meant one that does not account to the post office for postage imprinted. Clearly, it would be advantageous if one were able to provide a secure thermal printer that allows a determination as to whether there has been an accounting of postage.

SUMMARY OF THE INVENTION

A postage meter dispensing device has been conceived that provides a way of determining whether a postage indicia has been printed with an authorized postage dispensing device. A thermal ribbon is used which has preformed images. These preformed images are of segments of a postage indicia to be printed on an envelope through the application of pressure. Other portions of the ribbon have inked areas through which variable data, such as postage amount and date can be printed in the standard thermal printing. The preformed images on the thermal ribbon are created in a reduced size in the direction of travel of the ribbon relative to the size of the indicia to be printed. The pressure rollers that convey the ribbon and transfer the image are driven at a higher speed than the object to which the preformed image is to be transferred. A standard size indicia is printed as a result of the ribbon moving at a higher rate of speed than an envelope upon which it is printing. Downstream from the pressure rollers that transfer the preformed images is a thermal printhead that prints data on the envelope through the blank inked portions of the thermal ribbon. Of course, the data printed by the thermal printhead will be variable data; whereas, that portion printed as a result of the preprinted image and pressure is non-variable data, such as the logo, which in this case is an eagle. With this combination, a postage indicia can be printed on an envelope that yields a degree of security as one would not be able to print the indicia using a standard, off-the shelf thermal printer.

BRIEF DESCRIPTION OF THE DRAWING

In the accompanying drawing, like numbers are used to indicate like parts in different figures and.

DETAILED DESCRIPTION OF THE PREFERRED EMBODIMENT

Figure 1:
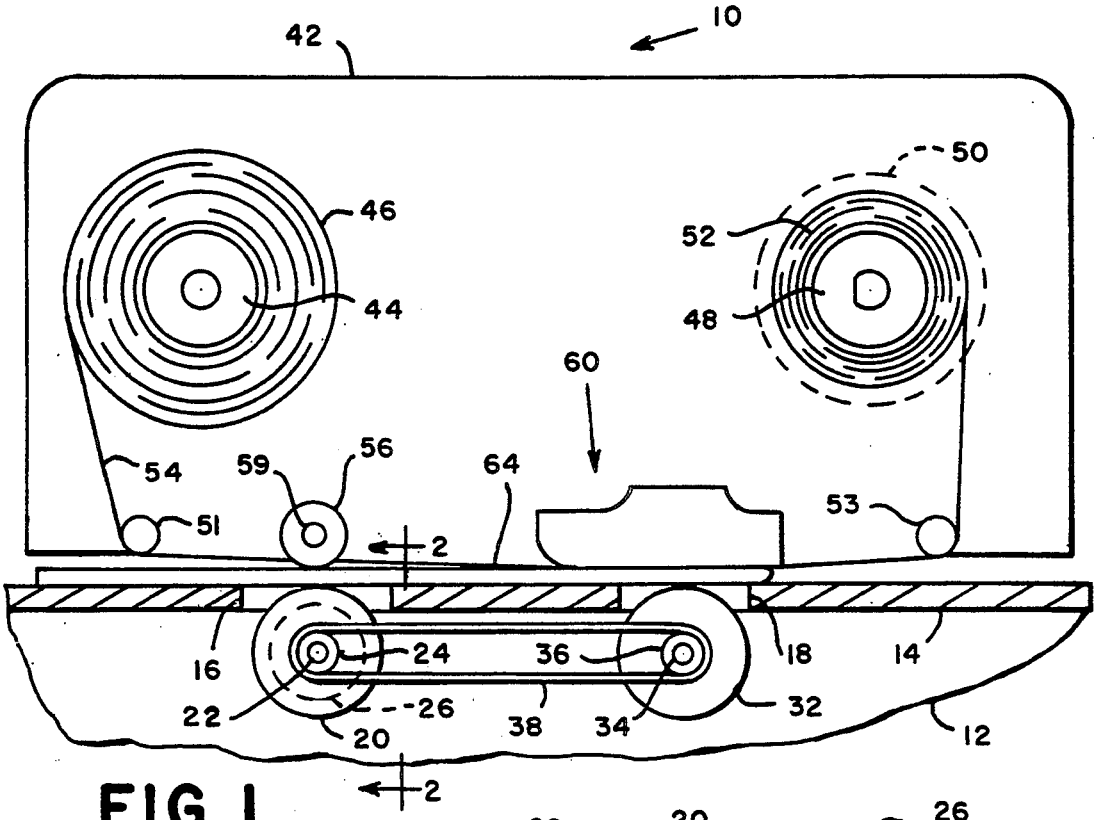
FIG. 1 is a longitudinal, cross sectional view of a postage dispensing device using a thermal printhead.
Figure 2:
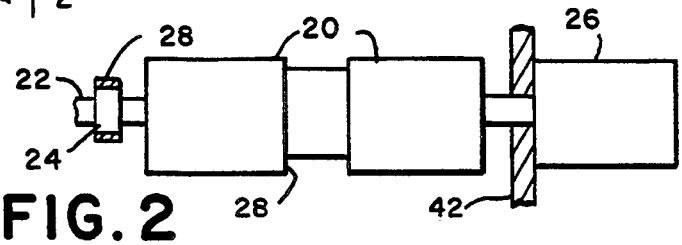
FIG. 2 is a longitudinal view of one of the rollers shown in FIG. 1 and taken along the lines 2—2.

With reference to FIGS. 1 & 2, a postage dispensing device is shown generally at 10, in which the instant invention can be practiced. The postage dispensing device 10 has a lower, housing 12 with a longitudinally extending deck 14 at the upper portion thereof. The deck 14 has a pair of laterally extending openings 16, 18. An impression roller 20 is received within the opening 16 and is mounted on a shaft 22, which shaft is supported by the lower housing 12. The shaft supports a pulley 24 on one end and is in engagement with a motor 26 at it's opposite end, the motor being supported within the housing 12. The roller 20 has a radial groove 28 about its peripheral intermediate its ends.

Another roller 32 is received within the opening 18 and is rotatably supported within the housing by a shaft 34. The shaft 34 supports a pulley 36 that is in longitudinal alignment with the pulley 24. A belt 38 is trained about the pulleys 24, 36 to transfer the drive from the pulley 24 to the pulley 36.

The postage dispensing device 10 has an upper housing 42 that supports a rotatable spindle 44 to which a thermal ribbon supply reel 46 can be mounted. A motor 50 is supported by the upper housing 42 and is connected to a rotatable spindle 48, upon which a thermal ribbon take-up reel 52 can be mounted. A pair of rollers 51, 53 are rotatably supported by the upper housing 42 and serve as guides for a thermal ribbon 54, so that the ribbon can be conveyed across the deck 14 by being pulled by the take-up reel 52 and unwound from the supply reel 46. The thermal ribbon 54 has preformed areas thereon as will be described hereinafter.

An impression roller 56 is disposed upon a shaft 58 that is rotatably supported by the upper housing 42. The roller 56 is in contact with the roller 20. The rollers 20, 56 are made of a resilient material, such as high temperature rubber, thereby allowing flat materials, such as an envelope 64, to pass therebetween while applying pressure to such flat materials. Such pressure will transfer a pre-formed image from the ribbon 54 to the envelope 64, except at the location of the groove 28. Alternatively, the roller 56 can be a heated roller so that the fixed image is thermally transferred. Intermediate the roller 56 and the roller 53, is a thermal printer 60 such as an IBM Quiet Writer III. This printer 60 contains a plurality of heating elements for causing the printing on a flat, such as an envelope 64, that is located between the ribbon 54 and roller 32.

Figure 3:
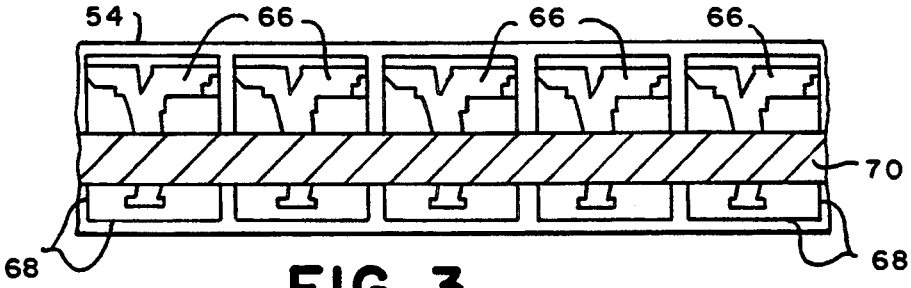
FIG. 3 is a plan view of a ribbon that incorporates features of the instant invention.
Figure 4:
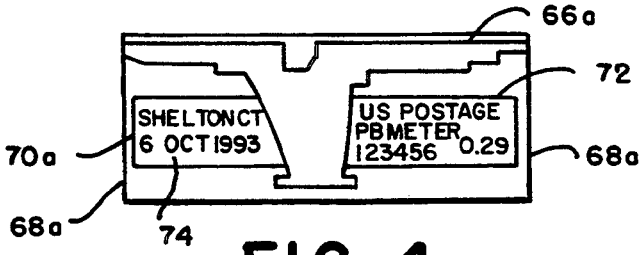
FIG. 4 is a plan view of a postage indicia printed by the device shown in FIG. 1.

With reference now to FIG. 3, a thermal ribbon that is made in accordance with the instant invention is shown and as a film 54, such as a polyester film, that has pre-formed portions of inked areas in the form of a logo 66 and border portions 68. The pre-formed data 66, 68 can be formed on the film 54 in any convenient manner, such as silk screen printing. Extending longitudinally on the film 54 is a wax ink coating strip 70 of the type used for thermal printing. The pre-formed logo 66, as well as the borders for the border portion 68, is smaller in the longitudinal direction than the image that is to be printed on an envelope as seen in FIG. 4 which is shown with data 72 and 74 that has been printed as a result of the preformed portions 66*a*, 68*a*, and the action of the thermal printer 60 on the ink strip 70*a*.

In operation, the supply reel 46 with the thermal ribbon 54 disposed thereon, as that seen in FIG. 1, is mounted on the spindle 44 and the take-up reel 50 is mounted on the spindle 48. The ribbon 54 is threaded through the device 10 as seen in FIG. 1 to be disposed on the take-up reel. The motor 50 will be enabled so that the ribbon 54 is driven across the deck as indicated by the arrow in FIG. 1. Simultaneously with the conveyance of the ribbon 54, an envelope 64 will be conveyed across the deck 14 in an asynchronous manner with the ribbon 54. More specifically, the motor 26 will rotate the shaft 22 at a higher rotational speed than motor 50 rotates the spindle 48 so that the envelope 64 is driven at a faster speed than the ribbon 54. As the envelope 64 passes between the impression rollers 20, 32, the fixed image 66 is transferred from the ribbon 54 to the envelope 64 to create images 66*a* thereon. Because of the difference in speeds of the envelope 64 and ribbon 54, the fixed images 66*a*, 68, are elongated when transfer on the ink from the ribbon 54 to the envelope 64 takes place. The transfer of such images 66, 68 results from the pressure applied to envelope 64 as it is conveyed between the rollers 20, 56. Preferably, the roller 56 has a small diameter, in the range of ½" so as to create a narrow footprint in terms of pressure applied to the ribbon 54. Having the ribbon 54 moving faster than the envelope 64 has two results, the logo 66 and borders 68*a*, 70*a* become elongated and the image smears. The smeared image is beneficial because it fills voids in the pre-formed image. Preferably, the envelope 64 will be driven at a rate of speed three times greater than the ribbon 54. For example, the ribbon can be driven at the rate of 3"/sec. and the envelope can be driven at the rate of 9"/sec. As stated previously, the image transfer could be accomplished thermally rather than through pressure.

As the envelope 64 passes the printer, the printer will be enabled so as to print the variable data at the location at the blank ink coating 70 in a conventional thermal printing manner. Thereafter, the envelope 64 is conveyed across the deck 14 to be discharged from the postage dispensing device 10.

Thus, what has been shown and described is a apparatus and method for having an asynchronous speed between the printing medium 54 and the surface 64 upon which it is printing. The asynchronous speed results in transferring the fixed data from a thermal ribbon 54 to an envelope 64 with a different size on the ribbon than the indicia printed on the envelope. Other advantages in use of the asynchronous movement between the ribbon 54 and envelope 64 involves the smearing of the printing on the envelope thus filling the voids that frequently result from printing, particularly with a dot matrix printer, and economy as less ribbon 54 is required. Further, greater forensic fraud detection is provided as distinctions can be seen at the meeting points of the preformed images 66*a*, 68*a* and the thermal printer position 70*a*.

The above embodiments have been given by way of illustration only, and other embodiments of the instant invention will be apparent to those skilled in the art from consideration of the detailed description. Accordingly, limitations on the instant invention are to be found only in the claims.

What is claimed is:

1. A postage dispensing device for printing postage on a flat comprising:

a supply of thermal ribbon having a first portion with pre-formed images and a second portion defining a longitudinal ink coating strip thereon, a longitudinally extending deck, a pair of first laterally extending, rotatable impression rollers in engagement with one another said impression rollers being a means to transfer said preformed image to a flat, a motor connected with one of said pair of first laterally extending impression rollers for rotatably driving said one of said laterally extending rollers at a first speed, a second laterally extending roller located on said deck longitudinally spaced from said one of said pair of first lateral extending impression rollers, a thermal printer located adjacent said deck and spaced relative to said second roller said thermal printer being a means to transfer part of said ink coating to form indicia on a flat, and means for conveying a thermal ribbon at a first speed between said pair of laterally extending impression rollers and between said printhead and said second laterally extending roller and means for conveying a flat between said thermal ribbon and of said rollers and between said thermal ribbon and said second roller speed at a second speed.

2. The postage dispensing device of claim 1 wherein said flat is a mail piece.

3. The postage dispensing device of claim 1 wherein said first speed is greater than said second speed.

4. The postage dispensing device of claim 1 wherein said pre-formed images on said thermal ribbon are fixed postage indicia data.

5. The postage dispensing device of claim 1 wherein said one of said pair of impression rollers has a peripheral groove intermediate its ends, said peripheral groove being in alignment with said ink coating strip.

6. A postage dispensing device for printing postage on a flat comprising:

a supply of thermal ribbon having a first portion with pre-formed images and a second portion defining a longitudinal ink coating strip thereon, a longitudinally extending deck having a pair of openings therein, a first pair of first laterally extending impression rollers in engagement with one another to form a nip, a first roller of said pair of rollers being received in one of said openings and the nip of said rollers being located along said deck said impression rollers being a means to transfer said pre-formed image to a flat, a motor in connection with said first one of said laterally aligned pressure rollers to rotate said first roller at a first speed, a third roller received within the second opening of said deck longitudinally spaced from said first of said pair of laterally extending impression rollers, a thermal printer located adjacent said deck and spaced relative to said second roller, said thermal printer being a means to transfer part of said ink coating to form indicia on a flat, and means for conveying a thermal ribbon at a first speed between said pair of laterally extending pressure rollers and between said thermal printer and said third roller and means for conveying a flat between said pair of rollers and between said third roller and said thermal printer at a second speed.

7. The postage dispensing device of claim 6 wherein said flat is an envelope.

8. The postage dispensing device of claim 6 wherein said first speed is slower than said second speed.

9. The postage dispensing device of claim 6 wherein said first roller of said pair of laterally extending impression rollers is a thermal roller.

10. The postage dispensing device of claim 6 wherein said second roller of said pair of impression rollers has a peripheral groove intermediate its ends that is in alignment with said ink coating strip.

11. A method of dispensing postage onto an envelope, the steps comprising:

a) pre-forming images on a thermal ribbon and placing a longitudinal ink coating on said thermal ribbon, b) conveying the pre-formed image thermal ribbon between a pair of laterally extending impression rollers at a first speed, c) conveying an envelope between one of the rollers and the pre-formed ribbon at a second speed to transfer the pre-formed image to said envelope from said thermal ribbon, d) conveying the envelope and pre-formed ribbon between a thermal printhead and a roller, and e) enabling the thermal printhead to create data on the envelope from the longitudinal coating on said thermal ribbon.

12. The method of claim 10 including conveying the envelope at a greater speed than the thermal ribbon is conveyed between the pair of laterally extending impression rollers.

* * * * *